United States Patent [19]

Grismer

[11] 4,106,950

[45] Aug. 15, 1978

[54] TANK WAGON CLEANING METHOD

[75] Inventor: Thomas A. Grismer, Dayton, Ohio

[73] Assignee: Economics Laboratory, Inc., St. Paul, Minn.

[21] Appl. No.: 846,380

[22] Filed: Oct. 28, 1977

[51] Int. Cl.[2] ..... B08B 3/02; B08B 9/08

[52] U.S. Cl. ..... 134/10; 134/22 R; 134/24; 134/26

[58] Field of Search ..... 134/22 R, 24, 10, 26, 134/168 R, 109, 115 R; 137/15, 238, 563, 565

[56] References Cited

U.S. PATENT DOCUMENTS

| | | | |
|---|---|---|---|
| 2,933,093 | 4/1960 | Handyside | 134/168 R |
| 3,033,215 | 5/1962 | Miller | 134/168 R X |
| 3,236,248 | 2/1966 | Ray | 134/24 X |

FOREIGN PATENT DOCUMENTS

| | | | |
|---|---|---|---|
| 1,433,487 | 4/1976 | United Kingdom | 134/24 |

*Primary Examiner*—S. Leon Bashore

*Assistant Examiner*—Marc L. Caroff

*Attorney, Agent, or Firm*—Merchant, Gould, Smith, Edell, Welter & Schmidt

[57] ABSTRACT

The interior of the tank of a tank truck or a tank wagon, is cleaned using a selectively removable sprayhead and the built-in delivery pump of the tank vehicle. A removable sprayhead is inserted into the interior of the tank through a manhole and connected, via the delivery pump, to an external storage source of a solvent or cleaning solution. The solvent is, for example, a mixture including a chlorinated aliphatic compound and an aromatic compound, both compounds having a freezing point below 60° C. The solvent is then pumped into the tank, and the hoses normally carried with the tank truck are connected so that the delivery pump can be used to recirculate the solvent through the tank. The solvent is recirculated until the tank is clean at which time it is pumped back into its original storage tank so that it can be reused.

6 Claims, 8 Drawing Figures

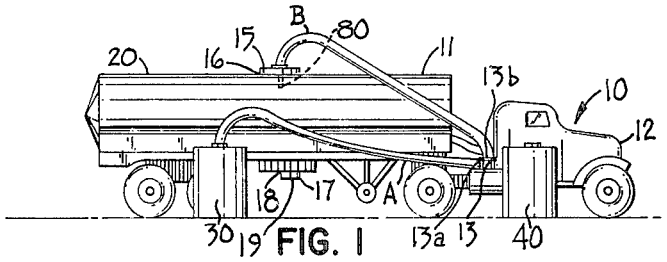
FIG. 1
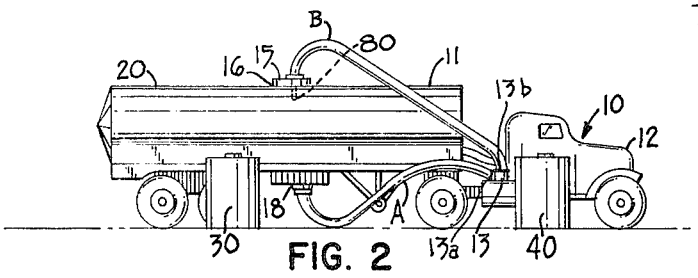
FIG. 2
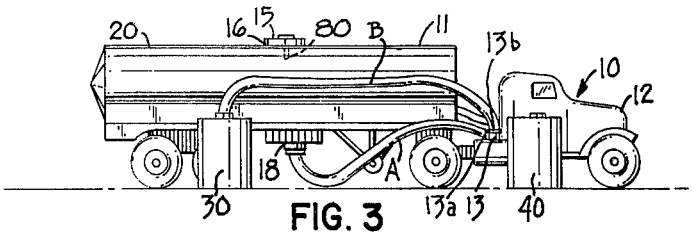
FIG. 3
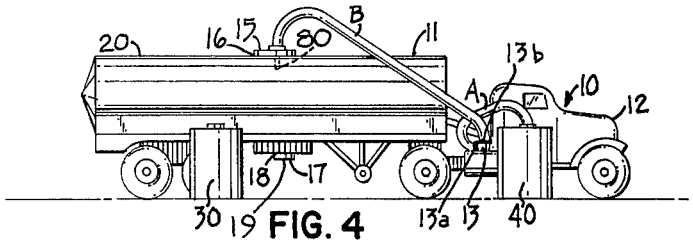
FIG. 4
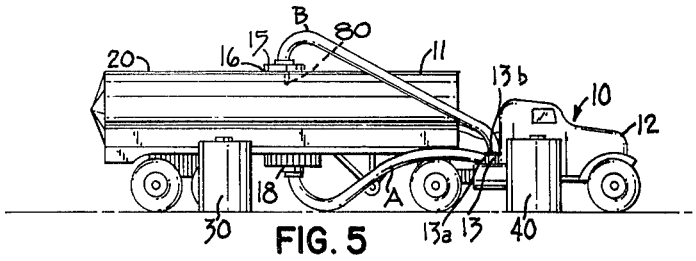
FIG. 5
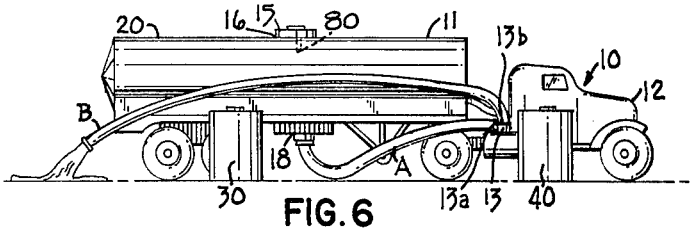
FIG. 6
71 "A" FROM CLEANING SOL. SUMP TO PUMP, "B" FROM PUMP TO COVER-PLATE SPRAYER
72 "A" FROM DRAIN TO PUMP, "B" FROM PUMP TO COVER-PLATE SPRAYER
73 "A" FROM DRAIN TO PUMP, "B" FROM PUMP TO CLEANING SOL. SUMP
74 "A" FROM RINSE-SOLUTION SUMP TO PUMP, "B" FROM PUMP TO COVER-PLATE SPRAYER
75 "A" FROM DRAIN TO PUMP, "B" FROM PUMP TO COVER-PLATE SPRAYER
76 "A" FROM DRAIN TO PUMP, "B" FROM PUMP TO WASTE
FIG. 7
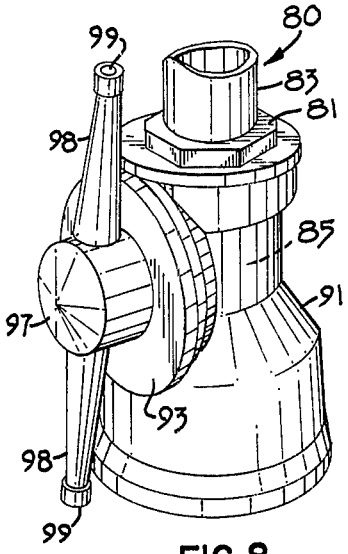
FIG. 8

TANK WAGON CLEANING METHOD

FIELD OF THE INVENTION

This invention relates to a method for cleaning a tank truck or a tank wagon. An aspect of this invention relates to the reuse of a cleaning solution. Still another aspect of this invention relates to a method of cleaning utilizing only a removable sprayhead and an externally stored cleaning solution in addition to the hoses and the built-in delivery pump normally carried on a tank truck.

DESCRIPTION OF THE PRIOR ART

A tank truck is commonly used to transport different chemicals at different times with successive cargoes often being incompatible. When different chemicals are hauled in the same tank truck at different times, it is usually necessary to wash the interior of the tank to remove one material before transporting another.

A number of different methods for cleaning tank trucks are known in the art. One of them is vapor degreasing. Vapor degreasing utilizes a closed system wherein a solvent, such as trichloroethylene, is heated with steam to vaporize it, the vaporized solvent being used to clean the tank. The operation is normally time-consuming and has a high equipment cost. For discussions of vapor degreasing see U.S. Pat. No. 3,042,553 (Kearney et al), issued July 3, 1962 and U.S. Pat. No. 3,549,421 (McFadden et al), issued Dec. 22, 1970.

Another known method, called the "sonic ray" method, involves the use of a sonic generator to generate a high intensity sonic field which is used in combination with the spray of a high boiling point solvent. For example, see U.S. Pat. No. 3,401,060 (Watts), issued Sept. 10, 1968.

It is also known to use spinning nozzle heads or sprayheads to spray a cleaning solution throughout the interior of a tank. One method involves the use of an air-tight recirculating tank and a high pressure pump. The pump pumps the cleaning solution from the recirculating tank into the tank being cleaned which creates a reduction in pressure in the recirculating tank which is used to suck the cleaning solution back into the recirculating tank. See U.S. Pat. No. 3,933,093 (Handyside), issude Apr. 19, 1960. The use of sprayheads in combination with essentially self-contained systems are also known. For example, U.S. Pat. No. 3,033,215 (Miller), issued May 8, 1962, discloses a completely self-contained system which includes a storage tank for the cleaning fluid, e.g. water, separate storage compartments for detergents, and a metering apparatus which is used to mix the cleaning fluid and the detergents in the correct proportions when they are pumped into the tank. The type of system disclosed in Miller has the advantage that it can be used to clean the tank of a tank truck while the tank truck is in transit. It has the disadvantage, however, of utilizing part of its potential storage space for carrying cleaning solutions and detergents instead of a chemical commodity, thus adding bulk and weight to the tank truck and eliminating revenue producing storage capacity. It has the further disadvantage of requiring several storage tanks, if several different cleaning solutions are required for cleaning different residues from carrying different chemicals during one "trip". Self-contained cleaning systems using pressurized gas in combination with a cleaning fluid to form a mist which is dispensed through a sprayhead are also known. See U.S. Pat. No. 3,188,238 (Lyon), issued June 8, 1965.

SUMMARY OF THE INVENTION

The present invention involves the discovery of an improved method for cleaning the interior of the tanks of tank trucks. The invention uses a reusable cleaning solution which is preferably an organic solvent mixture, normally stored in a storage tank external to the tank trucks being cleaned, which can be sprayed through a portable sprayhead inserted through a manhole of the tank being cleaned. The solvent or solvent mixture can comprise a chlorinated aliphatic liquid, an aromatic solvent, a lower alkanone or aldehyde, a sulfoxide, an organic acid, an amine, and/or an alcohol. Although these solvents are normally too expensive to be simply discarded, they are otherwise highly desirable in that their high level of chemical effectiveness typically obviates mechanical cleaning steps such as scrubbing or scraping. The cleaning method is self-contained in the sense that once the cleaning solvent has been pumped into the tank to be cleaned only the built-in delivery pump and the hoses normally carried on the tank truck are used during the cleaning process. Thus once the cleaning solvent has been introduced, the tank truck can be moved to a convenient location for cleaning while another tank truck is being filled with cleaning solution. When the tank has been cleaned the cleaning solution is pumped back into a storage tank for later reuse. The cleaning method of this invention includes the following steps:

(a) inserting a portable sprayhead through a manhole of the tank of a tank truck to be cleaned into the interior of the tank;
(b) connecting one hose between the outlet of the tank truck's delivery pump and the sprayhead;
(c) connecting a second hose between an external storage tank containing a reusable organic solvent mixture and the delivery pump inlet;
(d) pumping a quantity of solvent mixture from the external storage tank into the tank being cleaned;
(e) disconnecting the second hose from the external storage tank and connecting it to the drain of the tank being cleaned;
(f) starting the delivery pump and circulating the solvent mixture through the tank, the hoses, and the sprayhead until the tank is clean;
(g) stopping the delivery pump when the tank is clean (i.e. when the sediment, residue, or contaminant sought to be removed is dissolved or suspended in the solvent mixture and thereby cleaned off of the inside walls of the tank);
(h) disconnecting the first hose from the sprayhead and connecting it to the external storage tank for the solvent mixture; and
(i) pumping the reusable solvent mixture back into the tank where it is normally stored.

If the tank needs to be rinsed subsequent to cleaning, a similar procedure can be followed and the rinse solution discarded or reused, as desired.

Using the method of this invention is particularly advantageous when relatively large quantities of expensive solvents are required, since the solvent mixture is reused a number of times. Reuse also has the advantage that some solvents cannot be discharged to the sewer and thus require special means of disposal, i.e. incineration, which are costly and can be minimized by reuse. After several reuses, for example at least ten times, the contaminated solvent mixture can be reclaimed in a conventional manner and reused still further.

The method of this invention has the advantage over a "cleaning station" system (a system in which a tank truck must remain at the cleaning station throughout the cleaning process) of allowing the tank to be cleaned away from the station and thus preventing the cleaning station from becoming a bottleneck. In addition, the present invention allows the tank truck to be driven to a place where any odors given off by the cleaning solution are less bothersome. By utilizing the delivery pump already located on the tank truck and the hoses normally carried with the tank truck in the cleaning method, separate cleaning operations for these items are eliminated. (If desired, the standard hoses can be equipped with solvent resistant liners.) In general, the cleaning method of this invention has the advantage over a number of the prior cleaning methods because it requires little additional equipment, and it is economical and efficient.

BRIEF DESCRIPTION OF THE DRAWING

FIGS. 1 thorugh 6 are side elevational views illustrating the steps of the method of this invention.

Thus, FIG. 1 illustrates the hose connections used to pump the reusable cleaning solution from its external storage tank into the interior of the tank of the tank truck being cleaned;

FIG. 2 illustrates the hose connections used to recirculate the cleaning solution through the tank being cleaned;

FIG. 3 illustrates the hose connections used to pump the reusable cleaning solution back into its external storage tank;

FIG. 4 illustrates the hose connections used to pump the rinse solution from an external source into the tank being cleaned;

FIG. 5 illustrates the hose connections used to recirculate the rinse solution through the tank being cleaned; and FIG. 6 illustrates the hose connections used to discharge the rinse solution.

FIG. 7 is a flow chart outlining the hose connections for the cleaning method of this invention. The six steps denoted in the chart correspond to the hose connections illustrated in FIGS. 1–6.

FIG. 8 is a perspective view of a sprayhead device which can be used in the cleaning method of this invention.

DESCRIPTION OF THE PREFERRED EMBODIMENT

As noted previously, the cleaning method of this invention has advantages over a number of the prior art cleaning methods, since it requires little additional equipment and is economical and efficient. Very briefly, this invention provides essentially the advantages of totally self-contained systems using a liquid spray application (as opposed to generation of vapor and dispensing of a solvent in vapor form) of relatively expensive, reusable organic solvents; however, the invention also substantially eliminates the cost of outfitting individual tank trucks with specialized equipment. Typically, a standard, factory-equipped tank truck or trailer, provided with only the standard pump and hoses can be utilized in this invention without modification. If the tank requires cleaning with solvents which may chemically attack the standard hoses, it is generally desirable to insert solvent-resistant liners into the hoses or substitute solvent-resistant hoses with the same size and fittings as the standard hoses. Ordinarily, this modification for increased solvent resistance will be the only change needed in the standard equipment. Other equipment used in the process (e.g. the sprayhead device; a cover plate for the manhole which permits fluid-tight insertion of the sprayhead; external sumps for solvent, cleaning solution, or the like; etc.) can be maintained or stored or supplied at a cleaning station, and need not be integral with the truck or tank trailer structure or even transported by the truck. As will be apparent from the description which follows, a single sprayhead means or device can be transferred from one tank to the next, as can the cover plate. External storage of the solvent mixture or rinse solution is not believed to detract from the convenience or effectiveness of the method, but such external storage does increase the flexibility of selection of solvents, facilitate reclaiming of contaminated solvents, and obviate any need for decreasing storage capacity of the truck or tank trailer to make room for cleaning media or solvents.

These advantages are obtained through the use of the portable sprayhead means (e.g. the means or device illustrated in FIG. 7) and the unique combination of steps described in FIGS. 1–6 and 7 of the Drawing.

Turning now to the Drawing, wherein like numerals denote like parts in the various views, it will be seen from FIGS. 1–6 that the method of the invention has been illustrated with a typical tractor-trailer tank wagon 10 comprising tractor 12 and tank trailer 11 provided with a tank 20 for transporting liquids. However, it should be understood that arrangements other than the tractor-trailer combination can be used. For example, as shown in U.S. Pat. No. 3,717,285 (Hatton), issued Feb. 20, 1973, a tank can be mounted on a truck bed, so that the tank wagon is a single, powered mobile unit.

Although the liquid transported in tank 20 can be virtually any liquid which leaves a film, residue, or other contamination within the interior of tank 20 after it has been pumped out, most typically tank 20 will be used to transport chemicals (e.g. solvents, acids, bases, etc.), fuels, paints, varnishes, liquid resins or resin solutions, feeds and chemicals used in agriculture (molasses, corn steep liquors, fertilizers, insecticides, plant growth stimulants, etc.), wetting agents, liquid human edibles, natural extracts, tarry or bituminous liquids, and other liquids of commerce. Some of these liquid products, particularly resins pose very difficult tank cleaning problems in that they may leave solid residues which dissolve only in mixtures of powerful and hazardous organic solvents such as chlorinated aliphatics, ketones, alcohols, liquid carboxylic acids, aldehydes, aromatic liquids, or the like.

In all of FIGS. 1–6, it will be noted that tank wagon 10 is provided with the usual standard equipment, in this case a manhole 16, a center drain 18 including valve 19, a drain cap or cover 17, a pump 13 (shown mounted on the chassis of tractor 12; generally, although this is not commonly done, there is sufficient room for outfitting trailer 11 with a pump), inlet and outlet fittings **13*a* and 13*b*, respectively, for pump 13, and loading/unloading hoses A and B. As noted previously, virtually all bulk tank trucks or tank wagons have loading and unloading hoses and at least one pump. Pump 13** is also standard, in this case a reciprocating type having a capacity of 20–500 (e.g. 150–200) gallons per minute at 80 p.s.i.g.

Prior to setting up the configuration of hoses shown in FIG. 1, manhole cover 16 is opened and then closed again with a cover plate 15 stored at the cleaning station. Cover plate 15 is provided with a fitting for attaching sprayhead 80 to the underside and a hose to the upperside of the plate. When cover plate 15 is in place for carrying out the first cleaning step of the method, sprayhead 80 is inside of tank 20 and thus is shown in phantom in FIGS. 1-5.

Tank truck 10 has been parked close to solvent sump 30 and rinse solution sump 40. Center drain 18 is covered by drain cap 17 and valve 19 is closed, as would be the normal practice during transportation of liquids in tank 20. Tank wagon 10 is now ready for attachment of hoses A and B.

As shown in FIG. 1, hose A is connected to pump inlet 13*a* at one end and solvent sump 30 at its other end. Hose B is connected to outlet 13*b* of pump 13 at one end and connected to the fitting in cover plate 15 at its other end.

The configuration shown in FIG. 1 is now established, and a quantity of solvent can be pumped from sump 30 into tank 20. The pumping of the solvent will automatically cause sprayhead 80 to operate, thereby spraying the solvent throughout the tank and achieving some cleaning action. However, little or no reliance need be placed upon the cleaning which occurs during this relatively brief pumping step (i.e. the step shown in FIG. 1). As will be explained subsequently, some or even most of the cleaning action can take place with the hoses in the configuration shown in FIG. 2.

The amount of solvent pumped from sump 30 into tank 20 can be relatively small compared to the capacity of tank 20. For example, as little as 10 or 20 gallons of solvent can bring about a sufficient amount of cleaning action in the recirculating configuration shown in FIG. 2. Generally speaking, amounts of solvent in excess of 500 or 1,000 gallons are unnecessary, and 20-400 gallons will be the amount most typically used. Stated another way, the amount of solvent pumped from sump 30 into tank 20 in accordance with FIG. 1 can be a fraction of a percent of the total capacity of tank 20 (e.g. 0.5%) and ordinarily need not exceed 10 to 50% of the tank's capacity, by volume.

To provide the hose configuration shown in FIG. 2, it is only necessary to remove hose A from tank 30, remove drain cap 17 from drain 18, and attach hose A to drain 18. It will be seen that tank truck 10 is now independent of any external sump. Tank 20 itself is the sump for the solvent, and hoses A and B provide a closed circuit through which the solvent can be circulated from tank 20 when valve 19 is open, out through drain 18 to pump 13, from pump 13 to sprayhead 80, and back into tank 20. Sprayhead 80 can be selected to equal or exceed in its dispensing or throwing capacity the pumping capacity of pump 13. Thus, sprayhead 80 will typically be able to dispense a high velocity spray of solvent at a rate of at least about 20 gallons per minute, more typically at least 40 gallons per minute. The resulting spray pattern has been found to be as effective as solvent vapor, e.g. in a degreasing type of cleaning. For example, a 20 gallon-per-minute spray of a chlorinated lower aliphatic (methylene chloride, trichloroethane, trichloro or perchloro ethylene, etc.) has been found to do an excellent degreasing job comparable to vapor degreasing with the same solvent. It is preferred that the spray pattern extend approximately to the ends of tank 20, whereby the spray pattern, for all practical purposes, covers at least the lower half of the tank wall from one end of the longitudinal axis of the tank to the other, and at the ends of this axis. When a sprayhead device of the type shown in FIG. 8 is used, virtually the entire interior surface of tank 20 will be exposed to and contacted with the spray pattern. In this manner, a relatively small amount of solvent does a very massive cleaning job on the interior of the tank.

When the recirculation of the solvent has been completed, the solvent (which is typically too expensive and/or too damaging to the environment to be simply discarded) is returned to sump 30 for subsequent use in a different tank wagon. Although, for convenience of illustration, tank truck 10 is shown parked by sump 30 in all of FIGS. 1-6, it will be understood that tank wagon 10 can be driven to an unoccupied portion of the cleaning station (or even some remote location) just before or even during the recirculation in accordance with FIG. 2. That is, so long as tank truck 10 is independent of any external sump (a situation which also applied in the case of FIGS. 2 and 5), its location at the cleaning station is not critical. Indeed, it may ordinarily be preferred to move tank wagon 10 out of the way before recirculation, so that a different tank truck can be parked near sump 30.

Although the use of additional hoses is not preferred, hose extensions can be attached to hoses A and B so that tank wagon 10 need not be in close proximity to sump 30 while taking on or returning solvent. The ordinarily preferred procedure is to utilize only the hoses normally provided for tank wagon 10, which procedure ordinarily necessitates parking tank truck 10 within a hose length of sump 30 (or at least within a truck length).

The configuration of hoses shown in FIG. 3 is obtained simply by detaching one end of hose B from cover plate 15 and inserting the resulting free end into (or connecting this free end with) sump 30. Pump 13, which is shut off at the end of the recirculation step shown in FIG. 2 can now be restarted to rapidly pump the contaminated solvent from the bottom of tank 20 through drain 18 and hose A into and out of pump 13 and through hose B into sump 30. The relatively slight degree of contamination of the solvent in sump 30 does not preclude its reuse on at least nine or ten additional tank wagons. Indeed, discarding or reclaiming of the solvent in sump 30 may be unnecessary until at least about 30 tank wagons have been cleaned.

Tank wagon 10, after as little as a few minutes to a few hours (e.g. ten minutes to five hours) of recirculation in accordance with FIG. 2 and return of solvent in accordance with FIG. 3 is typically now ready for return to the truck fleet and the taking on of a new load of liquid material. In the event that it is desirable to remove the residue or traces of solvent 30 prior to taking on a new load, the rinsing procedure illustrated in FIGS. 4, 5, and 6 can be utilized for this purpose. If, on the other hand, rinsing is not necessary, the cleaning station operator has the option of replacing the manhole cover prior to the solvent return step illustrated in FIG. 3.

Assuming now that the rinsing step will be used (in which case cover plate 15 is left in place throughout FIGS. 1-5 and, at the option of the cleaning station operator, even during the step illustrated in FIG. 6), the rinsing operation is commenced by closing valve 19, disconnecting hose A from drain 18, and connecting hose A to rinse solution sump 40. Again, it is preferable to park tank wagon 10 within a hose-length of sump 40 to avoid the need for hose extensions; however, it is not essential that sumps 30 and 40 be as closely spaced as is shown in FIGS. 1-6. The method can be practiced easily with sumps 30 and 40 located in completely different areas of the cleaning station.

To complete the correct arrangement of hoses for the configuration shown in FIG. 4, the free end of hose B (this free end having been removed from sump 30) is attached to cover plate 15 in the same manner as was done for the configuration shown in FIG. 1. Indeed, the only difference in principle between the configurations shown in FIGS. 1 and 4 is that hose A is attached to a different sump. With the hose configuration shown in FIG. 4, rinse solution (e.g. an aqueous rinse such as aqueous caustic, a wetting agent or detergent solution, or the like) is pumped out of sump 40 in an amount similar to the amount of solvent pumped out of sump 30 in accordance with FIG. 1. As in the case of the solvent cleaning step, some rinsing action does occur during pumping, but the major amount of rinsing takes place when the hoses are in the configuration shown in FIG. 5. This recirculating configuration is, for all practical purposes, identical to that of FIG. 2 and is arrived at in the same manner. Again, tank wagon 10 is independent of any external sump while the hoses are in the recirculating configuration.

Particularly when inexpensive rinse liquids are used, the rinse solution need not be returned to sump 40 after recirculation, but can be discarded in accordance with the hose configuration shown in FIG. 6. Typical examples of inexpensive rinse liquids are tap water, an aqueous solution of sodium hydroxide, or other non-organic water-based rinses. As noted previously, the manhole cover can be replaced while tank 20 is pumped free of the rinse liquid. To arrive at the configuration shown in FIG. 6, in any event, one need only detach one end of hose B from cover plate 15 (replacement of cover plage 15 with the manhole cover being optional) and take the resulting free end of hose B and insert it in or direct it toward a drain, sewer, or the like.

If desired, an even simpler rinsing operation can be employed. In this simplified operation, drain cap 17 is not replaced and valve 19 is opened; tank wagon 10 is parked over a drain or sewer; and the rinse liquid is allowed to drain from tank 20 out through drain 18 while it is continuously being pumped into tank 20 from sump 40. Furthermore, in this simplified method and in the method shown in FIGS. 4-6, sump 40 can simply be replaced with a feed means such as a tap. For example, if the rinse liquid is plain water, there will ordinarily be no need for a separate additional sump 40.

FIG. 7 is a flow sheet describing the steps illustrated in FIGS. 1-6. Step (box) 71 of the flow sheet corresponds to FIG. 1, step 72 corresponds to FIG. 2, step 73 to FIG. 3, and so forth.

A preferred type of sprayhead is illustrated in FIG. 8. This sprayhead device or means 80 includes a threaded inlet 83 arranged for threaded engagement with a suitable fitting, e.g. the aforementioned fitting provided in cover plate 15. Below union 81, body 91 of sprayhead means 80 is rotatable around the vertical axis passing through threaded member 83 and body 91. Included within body 91 is a turbine 85 (indicated in phantom) which converts the influx of fluid through inlet 83 into a driving fluid for spinning body 91 and nozzle hub 97. Nozzle hub 97 rotates within fitting 93 along an axis which lies in a plane transverse to the aforementioned longitudinal axis of rotation of body 91. Nozzle arms 98 rotate with nozzle hub 97, and solvent sprays out through nozzles 99. The two axes of rotation create the desired spray pattern; rotation of nozzle hub 97 throws solvent upwardly and downwardly, while, at the same time, rotation of body 91 throws solvent outwardly for long distances, e.g. at least 10 feet and as much as 50 or 60 feet. The combined trajectories of the droplets of solvent provide a spray pattern which contacts all of the important interior areas of a tank.

Depending on if and what type of optional rinse procedure is used, sprayhead device 80 and cover plate 15 can be transferred to another tank wagon after step 73, step 74, step 75, or step 76. Sprayhead 80 is a relatively more expensive piece of equipment, and a cleaning station can function effectively with as few as one or two sprayheads, even though extra sprayheads and cover plates are desirable.

THE PREFERRED SOLVENT SYSTEMS

Depending upon the type of residue to be removed from tank 20, various reusable organic solvent systems or mixtures can be selected. Broadly speaking, two different embodiments of a reusable organic solvent mixture or solvent system are contemplated. First, a totally or almost totally organic solvent system can be used wherein any water, if present, is merely a minor polar component. Second, mixtures of highly effective, reusable (and often very expensive) organic solvents can be homogeneously mixed or blended with up to a major amount of water. For example, a caustic aqueous solution will dissolve large quantities of hydroxyaromatic compounds such as cresol, or phenol, due to the formation of the cresolate or phenate salt. Gluconate salts and the like can also be dissolved in water, as can the polar organic solvents (lower alkanols, acetone, lower organic acids, etc.).

For difficult-to-dissolve resins, it may be necessary to use the combination of a chlorinated aliphatic and an aromatic compound, both compounds having a freezing point below 60° C., and preferably at least one solvent being liquid at normal ambient temperatures (e.g. 20°-25° C.). For some rather common varnishes and the like, ketones, aldehydes, or lower aliphatic alcohols can be effective solvents. One of the advantages of the disclosed method is that environmental protection and occupational safety standards can ordinarily be satisfied even when toxic, hazardous, or highly explosive solvents are used. Solvent hazards are significantly reduced by keeping the system essentially closed at all times and by reusing the solvent. Improved occupational health and safety conditions can be obtained by moving the tank wagon to a remote location or specially designed safe area during recirculation of the solvent. The tank wagon is normally grounded when a flammable solvent is included in the cleaning solution.

The following list, which is by no means exhaustive, is intended to illustrate some of the highly effective and reusable but relatively expensive organic solvents contemplated for use in the method of this invention.

1. Chlorinated aliphatic (typically lower aliphatic) liquids such as methylene chloride, trichloroethane, trichloroethylene, and perchloroethylene.

2. Aromatic liquids and solvents (typically monocyclic) having a freezing point below 60° C. such as benzene; monocyclic alkyl aromatics (toluene, o-, m-, and/or p-xylene, ethylbenzene; etc.); hydroxyaromatics (phenol, o- and/or m-cresol and cresylic acid, etc.); benzyl compounds; aromatic amines (aniline, etc.); aromatic ethers (anisole, etc.); chlorinated aromatics (e.g. o-dichlorobenzene); nitrated aromatics; and heterocyclic aromatics such as pyridine.

3. Lower alkanones, e.g. ketones such as acetone, methylethylketone, etc.

4. Aldehydes such as formaldehyde, acetaldehyde, etc.

5. Sulfoxides such as dimethylsulfoxide.

6. Organic acids, including sulfonic acids and lower carboxylic acids such as formic, oxalic, acetic, and propionic.

7. Aliphatic amines (including alkanolamines).

8. Lower aliphatic alcohols such as methanol, ethanol, propanol, (e.g. isopropyl alcohol), butyl alcohol, amyl alcohol, and fusel oil.

9. Non-aromatic five- and six-member carboxylic and heterocyclic solvents, with or without substitution on the ring, e.g. cyclohexanone, dioxane, etc.

10. Ethers (if sufficient safety precautions are taken).

11. Esters, e.g. carboxylic acid esters such as ethyl acetate.

12. Coal or petroleum distillates, e.g. petroleum ether.

As noted previously, mixtures, reaction products, and derivatives of these solvents can be used, e.g. amine salts of organic carboxylic acids, so long as the product or mixture is liquid at normal ambient temperatures, has adequate solvent powers, and has a viscosity suitable for rapid pumping (e.g. a viscosity below 5,000 centipoise). Ordinarily, except for reduced vapor pressure and odor at room temperature, the salt forms of these solvents are less effective, particularly for paraffinic and other non-polar residues. In those cases where the residue to be cleaned from the tank has some polar character, aqueous cleaning solutions can be advantageous, otherwise, non-aqueous or substantially non-aqueous solvent systems are preferred.

What is claimed is:

1. In a method for cleaning the interior of the tank of a transport tank truck with a reuseable organic solvent mixture stored in a stationary external storage means external to said tank truck, said reuseable organic solvent mixture being sprayable from a portable sprayhead means, wherein the tank truck comprises:

(a) a pump means located on said tank truck, said pump means comprising an inlet means and an outlet means;

(b) an inlet hose means having a first and a second end, at least one end adapted for being connected to said pump inlet means;

(c) an outlet hose means having a first and a second end, at least one end adapted for being connected to said pump outlet means;

(d) a tank means located on said tank truck, said tank means being capable of transporting chemicals and comprising:

(1) a tank;

(2) a manhole means including a manhole cover located near the top of said tank;

(3) a drain means located near the bottom of said tank;

said cleaning method comprising:

(a) inserting a portable sprayhead means into the interior of said tank through said manhole means;

(b) connecting one end of said outlet hose means to said pump outlet means and connecting the second end of said outlet hose means to said sprayhead means;

(c) connecting one end of said inlet hose means to said pump inlet means and connecting the second end of said inlet hose means to said external storage means containing said reusable organic solvent mixture;

(d) pumping a residue-dissolving quantity of reusable organic solvent mixture from said external storage means into said tank;

(e) disconnecting said second inlet hose end from said external storage means and connecting said second inlet hose end to said drain means;

(f) starting said pump means and circulating said reusable organic solvent mixture through said tank, said drain means, said inlet hose means, said outlet hose means, and said sprayhead means;

(g) stopping said pump means;

(h) disconnecting said second outlet hose end from said sprayhead means and connecting said second outlet hose end to said external storage means; and (i) pumping said reusable organic solvent mixture out of said tank and back into said external storage means so that said reusable organic solvent mixture can be reused.

2. The cleaning method of claim 1 which further includes the use of a rinse solution dispensable from a stationary rinse solution supply means, said method comprising the additional steps of:

(a) disconnecting said second outlet hose end from said external storage means and connecting said second outlet hose end to said sprayhead;

(b) disconnecting said second inlet hose end from said drain means and connecting said second inlet hose end to a rinse solution supply means;

(c) pumping a rinsing quantity of said rinse solution from said rinse solution supply means through said sprayhead means into said tank;

(d) disconnecting said second inlet hose end from said rinse solution supply means and connecting said second inlet hose end to said drain means;

(e) starting said pump means and circulating said rinse solution through said tank, said drain means, said inlet hose means, said outlet hose means, and said sprayhead means;

(f) stopping said pump means;

(g) disconnecting said second outlet hose end from said sprayhead means;

(h) pumping said rinse solution out of said tank through said outlet hose means; and (i) removing said portable sprayhead means from said tank.

3. The cleaning method of claim 2 wherein said rinse solution is a non-organic, aqueous based solution.

4. The cleaning method of claim 1 wherein said reusable organic solvent mixture is reused at least ten times.

5. A method according to claim 1 wherein said reusable organic solvent comprises a solvent selected from the group consisting of a chlorinated aliphatic, a monocyclic aromatic, a ketone, a lower aliphatic alcohol, and mixtures thereof.

6. A method according to claim 1 wherein said reusable organic solvent mixture contains water.

* * * * *

UNITED STATES PATENT AND TRADEMARK OFFICE

CERTIFICATE OF CORRECTION

PATENT NO. : 4,106,950

DATED : August 15, 1978

INVENTOR(S) : Thomas A. Grismer

It is certified that error appears in the above-identified patent and that said Letters Patent are hereby corrected as shown below:

Abstract, lines 1 and 2, for "wagon, is cleaned" read --wagon is cleaned,--.
Column 1, line 45, for "3,933,093" read --2,933,093--.
Column 1, line 46, for "issude" read --issued--.
Column 4, line 9, for "like;" read --like,--.
Column 7, line 37, for "plage" read --plate--.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*